US008294591B2

(12) United States Patent
Reed et al.

(10) Patent No.: US 8,294,591 B2
(45) Date of Patent: Oct. 23, 2012

(54) DIGITAL SIGNAL PROCESSING RECEIVERS, SYSTEMS AND METHODS FOR IDENTIFYING DECODED SIGNALS

(75) Inventors: Christopher Paul Reed, West University Place, TX (US); David Kirk Conn, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 393 days.

(21) Appl. No.: 12/748,555

(22) Filed: Mar. 29, 2010

(65) Prior Publication Data

US 2010/0245121 A1 Sep. 30, 2010

Related U.S. Application Data

(60) Provisional application No. 61/164,648, filed on Mar. 30, 2009.

(51) Int. Cl.
*G01V 3/00* (2006.01)
*H03M 7/00* (2006.01)

(52) U.S. Cl. ..... 340/855.4; 341/50

(58) Field of Classification Search ..... 340/855.4, 340/855.5; 341/50, 51, 107, 155, 143
See application file for complete search history.

(56) References Cited

U.S. PATENT DOCUMENTS 5,375,098 A 12/1994 Malone et al.
5,471,189 A * 11/1995 Dietz et al. ..... 340/146.2
5,511,189 A * 4/1996 Machida ..... 712/300
7,148,820 B2 * 12/2006 Sakai et al. ..... 341/67
7,394,878 B2 * 7/2008 Nysen et al. ..... 375/343
7,463,184 B2 * 12/2008 Segawa ..... 342/52
2006/0293921 A1 * 12/2006 McCarthy et al. ..... 705/2

OTHER PUBLICATIONS

Monroe, S.P., Applying Digital Data-Encoding Techniques to Mud Pulse Telemetry, SPE 20326, Denver, Colorado, Jun. 25-28, 1990.

* cited by examiner

*Primary Examiner* — Peguy Jean Pierre
(74) *Attorney, Agent, or Firm* — Chadwick A. Sullivan

(57) ABSTRACT

A digital signal processing receiver, a system and/or a method identifies a decoded signal. The receiver, system and/or method extract at least one sequence of one or more symbols from a digital incoming signal to generate an extracted sequence of symbols. The receiver, system and/or method generate a first result based on a comparison of the extracted sequence of symbols and one or more possible matching digital signals of a set of idealized model data according to a Bayesian probability theory. The receiver, system and/or method generates a second result based on a comparison of an equalized version of the digital incoming signal and the one or more possible matching digital signals. The receiver, system and/or method generates a third result based on a comparison of the extracted sequence of symbols and one or more possible matching digital signals of a modified set of idealized model data. The receiver, system and/or method compare the first, second and third results to determine an idealized result, and identify a decoded signal for the actual incoming signal based on the idealized result.

20 Claims, 2 Drawing Sheets

DIGITAL SIGNAL PROCESSING RECEIVERS, SYSTEMS AND METHODS FOR IDENTIFYING DECODED SIGNALS

CROSS REFERENCE TO RELATED APPLICATION

This application claims the benefit of U.S. Provisional Application No. 61/164,648, entitled "Bayesian Equalizer MWD Receiver," filed Mar. 30, 2009, incorporated by reference herein.

FIELD OF THE INVENTION

The invention relates to a digital signal processing receiver, a system and a method for identifying decoded signals associated with telemetry pressure waves by determining matching signals based on digital data comparisons.

BACKGROUND OF THE INVENTION

Traditionally, a drilling operator utilizes one or more Measurement-while-drilling (hereinafter "MWD") tools and/or instruments and/or one or more Logging-while-drilling (hereinafter "LWD") tools and/or instruments (hereinafter "wellbore instruments") to provide control over construction and/or drilling of a wellbore. The wellbore instruments may provide the drilling operator with information regarding one or more conditions at a bottom of a wellbore substantially in real time as the wellbore is being drilled by a drill bit. To successfully and accurately construct and/or drill a well with the drill bit, the drilling operator may depend on the information obtainable from the bottom of the wellbore which may be provided in real time via the MWD and/or LWD tools and/or instruments.

The information provided by the MWD and/or LWD tools and/or instruments may include and/or may be based on one or more directional measurements, drilling-related measurements and/or directional drilling variables such as inclination and/or direction (azimuth) of the drill bit, and geological formation data and/or measurements, such as, for example, natural gamma ray radiation levels and electrical resistivity of the rock formation and/or the like.

In embodiments, the MWD tools and/or instruments may include one or more of the following types of measuring devices: a weight-on-bit measuring device; a torque measuring device; a vibration measuring device; a shock measuring device; a stick slip measuring device; a direction measuring device; an inclination measuring device; a gamma ray measuring device; a directional survey device; a tool face device; a borehole pressure measuring device; and/or a temperature device. The one or more MWD tools may detect, collect and/or log data and/or information about the conditions at the drill bit, around the formation, at a front of the drill string and/or at a distance around the drill strings. The one or more MWD tools may provide telemetry for operating rotary steering tools. It should be understood that the one or more MWD tools may be any type of MWD tools as known to one of ordinary skill in the art.

The LWD tools and/or instruments may include one or more of the following types of logging and/or measuring devices: a resistivity measuring device; a directional resistivity measuring device; a sonic measuring device; a nuclear measuring device; a nuclear magnetic resonance measuring device; a pressure measuring device; a seismic measuring device; an imaging device; a formation sampling device; a gamma ray measuring device; a density and photoelectric measuring device; a neutron porosity device; a bit resistivity measuring device, a ring resistivity measuring device, a button resistivity measuring device and/or a borehole caliper device. In an embodiment, the LWD tool may include, for example, a compensated density neutron tool, an azimuthal density neutron tool, a resistivity-at-the-bit tool, hookload sensor and/or a heave motion sensor. It should be understood that the LWD tools may be any type of LWD tools as known to one or ordinary skill in the skill.

Often wellbore instruments may be integrated into a single instrument package which may be referred to as MWD/LWD tools. In the description which follows, the term "MWD system" will be used collectively to refer to MWD, LWD, and/or a combination MWD/LWD tools and/or instruments. The term MWD system should also be understood to encompass equipment and/or techniques for data transmission from within the well to the earth's surface as known to one of ordinary skill in the art.

The MWD system may measure and acquire one or more parameters within the wellbore, and may transmit the acquired data measured by the MWD system to the earth's surface from within the wellbore. Traditionally, several different methods for transmitting data to the surface may be provided and, often, may include mud pulse telemetry. In mud-pulse telemetry, the acquired data may be transmitted from the MWD system in the wellbore to the surface by means of generating pressure waves in drilling fluid, such as, for example, which may be pumped through a drill string by pumps on the surface. The pressure waves in the drilling fluid may be produced or generated by the one or more components in of mud-pulse telemetry system as known to one of ordinary skill in the art.

One or more pressure transducers may be located on a standpipe at the earth's surface and generate one or more signals representative of variations in a pressure associated with the drilling fluid. As a result, the transducers may detect the one or more telemetry pressure waves and/or generate one or more signals which may represent one or more variations in the pressure associated with the drilling fluid generated by the one or more telemetry pressure waves. A digital signal processing receiver may detect the one or more signals generated by the transducers to recover the one or more symbols associated with the telemetry pressure waves and send data data from the one or more symbols to a central processing unit. The CPU 64 may generate information based on the data recovered from the one or more symbols which may be accessible by the drilling operator for constructing and/or drilling of a wellbore.

However, the telemetry pressure wave may be subjected to attenuation, reflections, and/or noise as the telemetry pressure wave moves through the drilling fluid. The telemetry pressure waves may also be reflected or partial reflected off the bottom of the wellbore or at one or more acoustic impedance mismatches in the drill string and a surface drilling fluid system. The one or more components of a surface drilling fluid system, such as, for example, a mud pump may generate noise which may interfere telemetry pressure waves. The result of the attenuation, reflections and noise may prevent the digital signal processing receiver from accurately recovering the one or more symbols associated with the telemetry pressure waves.

Historically, the digital signal processing receiver exhibits may slightly reduce or fail to reduce the occurrences of double bit errors due to differential encoding and/or may fail to exhibit increases in resolution and accuracy of the bit confidence of each bit and fails to reduce occurrences of double bit errors. As a result, the digital signal processing receiver fails to filter out incorrect and/or questionable symbols and/or does not reduce errors from being included into logs based on the telemetry pressure waves.

Thus, the receivers, systems and methods for identifying decoded signals are necessary in order to (1) provide improved overall performance, resolution and accuracy of the bit confidence of each bit, (2) prevent occurrences of double bit errors due to differential encoding, (3) filter out all or substantially all incorrect and/or questionable symbols and/or data points, and (4) prevent all or substantially all errors from being included into logs generated by the receivers, systems and/or methods. As a result, the receivers, systems and methods for identifying decoded signals advantageously decreases double symbol errors and/or bit errors which results in an advantageously lower bit error rate (hereinafter "BER").

DETAILED DESCRIPTION OF EMBODIMENTS

Figure 1:
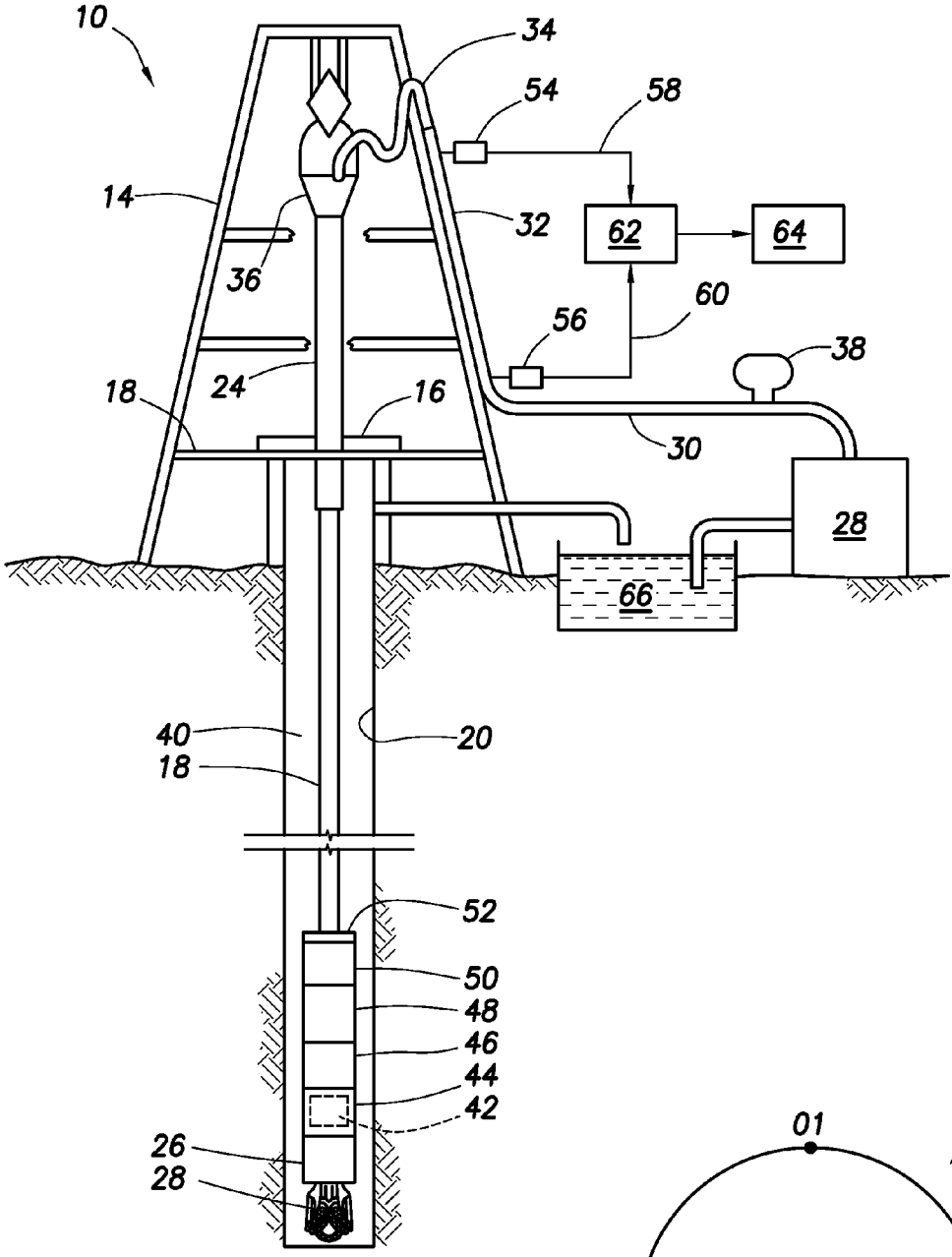
FIG. 1 illustrates a schematic diagram of a drilling system including a MWD system having mud pulse telemetry in an embodiment of the present invention.

The invention relates to a digital signal processing receiver (hereinafter "receiver"), a system and/or a method for identifying a decoded signal. The receiver, the system and/or the method may detect a telemetry pressure wave transmittable via drilling fluid, such as, for example, a drilling mud. The receiver, the system and/or the method may transform the telemetry pressure wave into an incoming digital data signal (hereinafter "incoming signal"). The receiver may be, for example, a measure-while-drilling (hereinafter "MWD") receiver which may be located at the earth's surface. The receiver, the system and/or the method may process, estimate, record, display and/or filter the incoming signal to identify and/or determine a digital bit pattern (hereinafter "bit pattern") associated with and/or defining the incoming signal. The receiver, system and/or method may determine and/or identify an idealized digital data signal (hereinafter "idealized signal") which may match and/or correspond to the bit pattern of the incoming signal based on two or more digital data comparisons (hereinafter "data comparisons"). The receiver, system and/or method may assign the idealized signal to the incoming signal such that the incoming signal may be identified as and/or represented by the idealized signal. As a result, the idealized signal assigned to the incoming signal may be identified as a decoded digital data signal (hereinafter "decoded signal") for the incoming signal by the receiver, the system and/or the method.

The data comparisons performed and/or executed by the receiver may include a first data comparison of the incoming signal with an initial set of two or more idealized digital data signals and/or an initial set of idealized model data (hereinafter "set of idealized model data") according to a probability theory. The set of idealized model data may include one or more idealized digital bit patterns (hereinafter "idealized bit patterns") which may be comparable to the bit pattern of the incoming signal via the receiver according to the probability theory. The receiver, system and/or method may determine and/or identify an idealized bit pattern from the idealized bit patterns of the set of idealized model data which may accurately or substantially accurately match, represent and/or correspond to the bit pattern of the incoming signal according to the probability theory for generating a first result of the first data comparison.

Further, the data comparisons performed and/or executed by the receiver may include a second data comparison of an equalized version of the incoming signal with the set of idealized model data. The receiver, the system and/or the method may have one or more equalizers that may attempt to recover the bit pattern of the incoming signal and/or to generate or produce the equalized version of the incoming signal. The receiver, system and/or method may determine and/or identify an idealized bit pattern from the idealized bit patterns which may accurately or substantially accurately match and/or correspond to a bit pattern associated with the equalized version of the incoming signal according for generating a second result of the second data comparison.

Still further, the data comparisons performed and/or executed by the receiver may include a third data comparison of the incoming signal with a set of one or more modified idealized data signals and/or modified idealized model data (hereinafter "set of modified idealized model data"). The set of modified model data may be based on and/or representative of a channel response associated with the set of idealized model data. The set of modified idealized model data may include one or more modified idealized digital bit patterns (hereinafter "modified idealized bit patterns"). The receiver, system and/or method may determine and/or identify a modified idealized bit pattern from the modified idealized bit patterns of the set of modified idealized model data which may accurately or substantially accurately match and/or correspond to the bit pattern associated with the incoming signal to generate a third result of the third data comparison.

Moreover, the receiver, the system and/or the method may determine and/or identify a decoded signal which may accurately or substantially accurately match and/or correspond to the bit pattern of the incoming signal based on one or more the idealized bit patterns and the modified idealized bit pattern determined and/or identified by the receiver in the one or more data comparisons. The receiver, the system and/or the method may determine and/or identify the decoded signal based on the first, second and/or third result from the first, second and/or third data comparisons, respectively. The receiver, the system and/or the method may assign the determined and/or identified decoded signal to the bit pattern of the incoming signal such that the decoded signal may be representative of the bit pattern of the incoming signal.

Referring now to the drawings wherein like numerals refer to like parts, FIG. 1 illustrates a drilling system 10 which may be on-shore or off-shore, in which the present receivers, systems and/or methods for identifying a decoded signal may be implemented. Embodiments of the present invention may be utilized with vertical, horizontal and/or directional drilling.

The drilling system 10 may include a drill string 12 suspended from a derrick 14. The drill string 12 may extend through a rotary table 16 on a rig floor 18 into a wellbore 20. A drill bit 22 may be attached to an end of the drill string 12. Drilling may be accomplished by rotating the drill bit 22 while some of the weight of the drill string 12 may be applied to the drill bit 22. The drill bit 22 may be rotated by rotating the entire drill sting 12 from the surface using the rotary table 16 which may be adapted to drive a kelly 24, or alternatively by using a top drive (not shown in the figures). Alternatively, a positive displacement motor known as a mud motor 26 may be disposed in the drill string 12 above the drill bit 22. As a result, drilling can be accomplished without rotating the entire drill string 112.

While drilling, drilling fluid may be pumped by mud pumps 28 on the surface through surface piping 30, standpipe 32, rotary hose 34, swivel 36, kelly 24 and subsequently down the drill string 12. Pulsation dampeners 38, also known as "desurgers" or "accumulators", may be located near outputs of the mud pumps 28 to smooth pressure transients in the mud discharged from the mud pumps 28. The drilling fluid in the drill string 12 may be forced out through jet nozzles (not shown in the figures) in a cutting face of the drill bit 22. The drilling fluid may be returned to the surface through an annular space 40 between the wellbore 20 and the drill string 12 (hereinafter "the well annulus 40"). At least one sensor and/or transducer 42 (hereinafter "transducer 42") may be located in a measurement module 44 in a bottomhole assembly portion of the drill string 12 to measure, collect and/or acquire one or more measurements and/or data associated with one or more downhole conditions. It should be understood that the transducer 42 and/or the measurement module 44 may be any type of logging and/or measuring device as known to one of ordinary skill in the art.

For example, the transducer 42 may be, a strain gage that may measure weight-on bit (i.e., axial force applied to the drill bit 22) or a thermocouple that may measure temperature at the bottom of the wellbore 20. Additionally, one or more sensors may be provided as necessary to measure other drilling and formation parameters as known to one of ordinary skill in the art. In embodiments, the transducer 42 may detect and/or acquire data associated with one or more sonic, nuclear, gamma ray, photoelectric and/or resistivity measurements.

The acquired measurements and/or data (hereinafter "acquired data") collected and gathered by the transducer 42 may be transmitted to the surface through the drilling fluid in the drill string 12. The transducer 42 may send one or more data signals representative of the acquired data for the one or more downhole conditions to a downhole electronics unit 46. The one or more data signals sent from the transducer 42 may be digitized by an analog-to-digital converter (not shown in the figures). The downhole electronics unit 46 may then collect the acquired data from the transducer 42 and may arrange the acquired data into a telemetry format, such as, for example, a digital representation of the acquired data made by the transducer 42. The digital representation of the acquired data may include one or more digital bits representative of the acquired data. One or more additional digital bits may be added to the telemetry format of the acquired data. The one or more additional digital bits may be used for synchronization, error detection, error correction and/or the like.

The telemetry format may be passed from the downhole electronics unit 46 to a modulator 48. The modulator 48 may group the one or more digital bits of the telemetry format into one or more symbols and may utilize a modulation process to impress the symbols onto one or more basebands or carrier waveforms (hereinafter "one or more modulated signals"). The one or more symbols may be transmitted through the drilling fluid in the drill string 12 via the one or more modulated signals producible by the modulator 48. Each of the one or more symbols may consist of a group of one or more bits. The one or more modulated signals may be utilized as input to an acoustic transmitter 50 and/or a valve mechanism 52 which may generate one or more telemetry pressure waves. The one or more telemetry pressure waves in the drilling fluid generated by the acoustic transmitter 50 and/or the valve mechanism 52 may carry or transmit the acquired data, the one or more digital bits of the telemetry format, the one or more symbols, and/or the one or more modulated signals to the surface.

In embodiments, output from the modulator 48 may be transferred to the acoustic transmitter 50, which may produce the telemetry waveform signal that may propagate through the drilling fluid channel to the earth's surface. The telemetry waveform signal may include the bit pattern for the incoming signal which may be transmitted uphole via the drilling fluid channel. The telemetry waveform signal may be a baseband waveform whereby, for example, the one or more symbols and/or the bit pattern may be transmitted using a technique called line coding based on a line code. Examples of a line code which may be utilized to impress the information on to the baseband waveform may include a non-return-to-zero (NRZ), Manchester code, Miller code, time analog, and pulse position modulation. In embodiments, the line codes may include AMI, Modified AMI codes (B8ZS, B6ZS, B3ZS, HDB3), 2B1Q, 4B5B, 4B3T, 6b/8b encoding, Hamming Code, 8d/10b encoding, 64b/66b encoding, 128b/130b encoding, Coded mark inversion, Conditioned Diphase, Return-to-zero (RZ), inverted Non-return-to-zero (NRZI), MLT-3 Encosing, Hybrid Ternary Codes, Surround by complement, TC-PAM and/or like. The line code may be a line code as known by one of ordinary skill in the art. See for example, S. P. Monroe, Applying Digital Data-Encoding Techniques to Mud Pulse Telemetry, paper no. 20326, Proceedings of the Petroleum Computer Conference, Denver, Jun. 25-28, 1990, pp. 7-16, Society Of Petroleum Engineers, Richardson, Tex.

Alternatively to line coding, the modulator 48 and/or the acoustic transmitter 50 may perform a modulation process whereby the symbols and/or the may be impressed onto a suitable carrier by varying the amplitude, phase, or frequency of a carrier, usually a sinusoidal signal, in accordance with the value of the bit pattern and/or the single bit or the group of bits, which may make up the one or more symbols. For example, in binary phase shift keying (BPSK) modulation, the phase of a constant amplitude carrier signal may be switched between two values according to the two possible values of a binary digit, corresponding to binary 1 and 0, respectively. Examples of other modulation types may include amplitude modulation, frequency modulation, minimum shift keying, frequency shift keying, phase shift keying, 8-PSK, phase modulation, continuous phase modulation, quadrature amplitude modulation, and trellis code modulation. These modulation types and the aforementioned line codes are known in the art. See, for example, John G. Proakis, Digital Communications, 3rd edition, McGraw-Hill, Inc. (1995), and Theodore S. Rappaport, Wireless Communications, pp. 197-294, Prentice Hall, Inc. (1996). In embodiments, the modulation type may include quadrature phase-shift keying, Offset QPSK, $\pi/4$-QPSK, shaped-offset QPSK, dual-polarization QPSK or DQPSK.

In embodiments, the valve mechanism 52 may be a rotary valve or mud siren that may generate periodic waveforms in fluid. An example of a mud siren is disclosed in U.S. Pat. No. 5,375,098 issued to Malone et al., assigned to the assignee of the present invention. The valve mechanism 52 may not have to be a mud siren, but alternatively may be a valve that may generate one or more positive telemetry pressure waves or negative telemetry pressure waves as known to one having ordinary skill in the art.

The pumping action of the mud pumps 66 may be generally periodic and/or may produce a constant flow component with periodic components superimposed thereon. Mud pump noise may be characterized as a set of "tones" with each tone occurring at an integer multiple of a mud pump's fundamental frequency. The pulsation dampeners 38 on an outlet side of the mud pumps 28 may assist to reduce and/or smooth fluctuations in mud pump pressure and/or flow. However, the noise from the mud pumps 28 may be substantially stronger than the MWD telemetry signal and/or telemetry pressure wave arriving at the surface. A fundamental frequency of the periodic component of the output of each mud pump may be time-varying. Amplitudes of some of the harmonic tones may be considerably larger than others, depending on the type of pump. For example, a "triplex" (i.e., three cylinder) pump may have a majority of its noise present at multiples of the third harmonic of that pump. Thus, third, sixth, ninth, twelfth harmonics etc. may be predominant for a triplex pump. The third and sixth harmonics may be the largest. Similarly, for a "duplex" (two cylinder) pump, the second, fourth, sixth, etc. harmonics may be predominant.

One or more pressure transducers 54, 56 (hereinafter "pressure transducers 54, 56") may be located on the standpipe 32 or surface piping 30 at the earth's surface and/or may measure at least one parameter associated with the telemetry pressure wave transmitted uphole via the drilling fluid channel. The one or more pressure transducers 54, 56 may generate one or more signals which may be representative of variations in a pressure associated with the drilling fluid. The variations in the pressure associated with the drilling fluid may be based on the one or more telemetry pressure waves in the drilling fluid generated by the acoustic transmitter and/or the valve mechanism. In embodiments, the transducers 54, 56 may measure pump pressure and/or may be alloy film sensor having an ion-beam sputtering alloy film sensor and a signal modulation circuit. As a result, the transducers 54, 56 may detect the one or more telemetry pressure waves and/or generate one or more signals which may represent one or more variations in the pressure associated with the drilling fluid generated by the one or more telemetry pressure waves. The pressure transducers 54, 56 may generate the outputs 58, 60, respectively, that may be representative of the measured parameter associated with the telemetry pressure wave. The measured pressure of the drilling fluid may be a sum of a telemetry signal component and a mud pump noise component.

Figure 3:
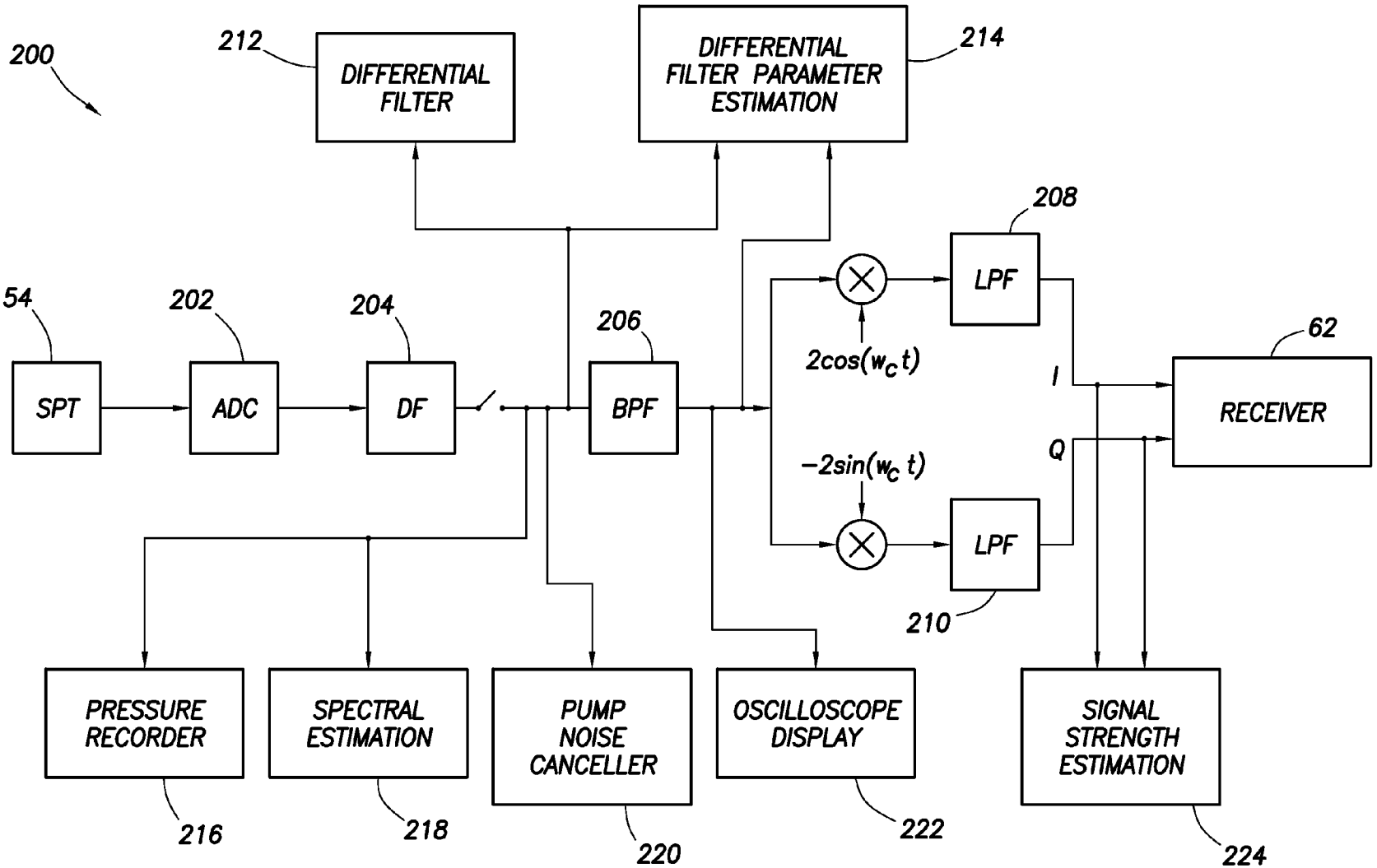
FIG. 3 illustrates a schematic diagram of data preprocessing system for a receiver in an embodiment of the present invention.

The pressure transducers 54, 56 may produce one or more electrical signal outputs 58, 60 (hereinafter "the outputs 58, 60"), respectively, based on the one or more signals which may be representative of one or more variations in the pressure associated with the drilling fluid. The incoming signal and/or the outputs 58, 60 from the pressure transducers 54, 56 may be digitized in analog-to-digital converters 202 (hereinafter "AD converter 202"), as shown in FIG. 3, and/or transmitted to and processed by a digital signal processing receiver 62 (hereinafter "the receiver 62") as shown in FIGS. 1 and 3. In embodiments, the receiver 62 may be, for example, a MWD digital signal processing receiver and/or detect a telemetry pressure wave in the drilling fluid and may transform the telemetry pressure wave into an electrical impulse. The receiver 62 may recover the one or more symbols from the one or more variations in the pressure associated with the mud and/or may send data recovered from the one or more symbols to a central processing unit 64 (hereinafter "the CPU 64") as shown in FIG. 1. The CPU 64 may generate information based on the data recovered from the one or more symbols which may be accessible by the drilling operator for constructing and/or drilling of a wellbore.

There are several mud-pulse telemetry systems known in the art. This mud-pulse telemetry may include a positive-pulse system, a negative-pulse system, and a continuous-wave system. In a positive-pulse system, valve mechanism 52 of the acoustic transmitter 50 may create a telemetry pressure wave at a higher pressure than that of the drilling fluid by momentarily restricting flow of the drilling fluid in the drill string 12. In a negative mud-pulse telemetry system, the valve mechanism 50 may create a telemetry pressure wave at a lower pressure than that of the drilling fluid by venting a small amount of the drilling fluid in the drill string 12 through a valve of the valve mechanism 50 to the well annulus 40. In both the positive-pulse and negative-pulse systems, the telemetry pressure waves may propagate to the surface through the drilling fluid in the drill string 12 and/or may be detected by the pressure transducers 54, 56. To send a stream of acquired data uphole to the surface, a series of telemetry pressure waves may be generated in a pattern that may be recognizable by the receiver 62.

The telemetry pressure waves generated by positive-pulse and negative-pulse systems may be discrete telemetry pressure waves that move through the drilling fluid within the drill string 12. In embodiments, the drilling fluid within the drill string 12 utilized for transmitting the telemetry pressure waves may be referred to as a fluid channel. Continuous pressure wave telemetry may be generated with a rotary valve or a mud siren as commonly known in the art. In a continuous-wave system, the valve mechanism 52 may rotate so as to repeatedly interrupt the flow of the drilling fluid in the drill string 12. As a result, a periodic telemetry pressure wave may be generated at a rate that may be proportional to the rate of interruption. Information may be transmitted by modulating the phase, frequency, or amplitude of the periodic wave in a manner related to the acquired data which may be gathered and/or collected downhole via the transducer 42.

The telemetry pressure wave carrying information from the acoustic transmitter 50 to the pressure transducers 54, 56 may be subjected to attenuation, reflections, and/or noise as the telemetry pressure wave moves through the drilling fluid. Signal attenuation as it passes through the fluid channel may or may not be constant across a range of component frequencies which may be present in the telemetry pressure wave. Typically, lower frequency components may be subject to less attenuation than higher frequency components. The telemetry pressure waves may also be reflected off the bottom of the wellbore, and/or may be at least partially reflected at one or more acoustic impedance mismatches in the drill string 12 and a surface drilling fluid system. The surface drilling fluid system may include the mud pumps 28, surface piping 30, standpipe 32, rotary hose 34, swivel 36, and pulsation dampeners 38. As a result, the telemetry pressure waves arriving at the pressure transducer 54, 56 on the standpipe 32 may be a superposition of a main telemetry pressure wave from the acoustic transmitter 50 and/or multiple reflected telemetry pressure waves. The result of the reflections and frequency dependent attenuation may be that each of the transmitted symbols becomes spread out in time and/or may interfere with symbols preceding and/or following those transmitted symbols, which may be referred to as intersymbol interference (hereinafter "ISI").

Pressure waves from the surface mud pumps 28 may contribute considerable amounts of pump noise which may result in reciprocating motion of mud pump pistons and/or may be harmonic in nature. The pressure waves from the mud pumps 28 may travel in the opposite direction from the telemetry pressure wave, namely, from the surface down the drill string 12 to the drill bit 22. The pressure transducers 54, 56 may detect pressure variations representative of a sum of telemetry pressure waves and noise waves. Components of the noise from the surface mud pumps 28 may be present within one or more frequency ranges which may be used for transmission of the telemetry pressure wave. The components of the noise waves from the surface mud pump 28 may have considerably greater power than the received telemetry pressure wave which may make correct detection of the received symbols from the telemetry pressure wave very difficult and/or impossible. Additional downhole sources of noise may include the drilling motor 26, and drill bit 22 interaction with the formation being drilled. All these factors may degrade the quality of the received signal from the telemetry pressure waves and/or may increase difficulty to recover the one or more symbols being transmitted via the telemetry pressure waves. Moreover, mechanical vibration of the rig 14 and electrical noise coupling onto the electrical wiring that carries the outputs 58, 60 from the sensors 54, 56, respectively, to the receiver 62 on the surface may also degrade the reception of the signal being transmitted via the telemetry pressure waves.

The one or more symbols modulated into the one or more modulated signals and/or the group of one or more bits of the one or more modulated signals may be received by the pressure transducers 54, 56 and may be identified as an incoming signal. The incoming signal may be processed by the pressure transducers 54, 56 and/or may be transmitted from the pressure transducers 54, 56 to the receiver 62 as the outputs 58, 60 of the pressure transducers 54, 56, respectively. An inference problem associated with the incoming signal and/or outputs 58, 60 transmitted to the receiver 62 from the pressure transducers 54, 56 may include accurate detection and/or identification of the actual and/or original symbols originally transmitted uphole via the telemetry pressure waves. From prior knowledge or assumptions a set of possible symbols for the incoming signal is derived. The probability of each symbol of the set for the incoming signal may be compared to probability of the other symbols of the same set.

The probability theory may be, for example, at least one of a discrete probability theory, a continuous probability distributions and a measure-theoretic probability theory. In embodiments, the probability theory may be a Bayesian probability theory. The probability theory may provide that a probability of an unknown can be derived from the probabilities of all possibilities. Thus, an incoming signal may be compared with all possible signals that the incoming signal may actually be. A matching and/or idealized signal may be selected to represent the incoming signal based on the comparison of the block of the incoming signal to the possible signals.

Figure 2:
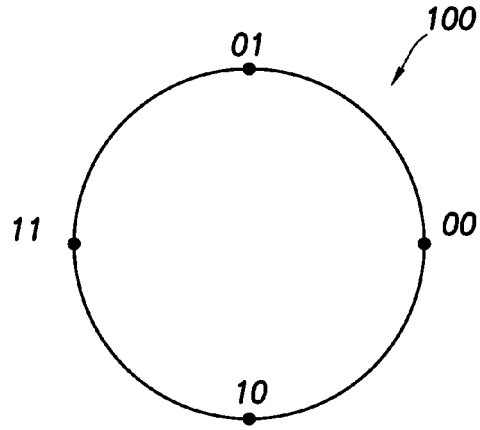
FIG. 2 illustrates a schematic diagram of a quadrature phase shift keying constellation for modulation that may be used in practicing embodiments of the method of the present invention.

The receiver 62 may control, perform and/or execute one or more filtering operations for the outputs 58, 60 and/or the incoming signal received from the pressure transducers 54, 56. The one or more filtering operations may process the outputs 58, 60 and/or the incoming signal to extract one or more symbols and/or one or more groups of one or more bits originally transmitted uphole via the one or more telemetry pressure waves. A form of modulation used by the receiver 62 may be, for example, differential quadrature phase shift keying (hereinafter "DQPSK") modulation which may utilize a four (4) symbol constellation as shown in FIG. 2. When utilizing DQPSK modulation, each symbol may be decoded based on a relative phase change between a current symbol and a previously decoded symbol. The receiver 62 may utilize two or more data comparisons for each symbol to determine the actual and/or original symbol transmitted uphole. By utilize two or more data comparison for each symbol, the receiver may decrease double symbol errors and/or bit errors which results in an advantageously lower BER.

FIG. 3 illustrates a data preprocessing system 200 (hereinafter "system 200") for transmitting the bit pattern of the incoming signal and/or the output 58 of the pressure transducer 54 to the receiver 62. The bit pattern of the incoming signal and/or the output 58 received by the pressure transmitter 54 may be transmitted to the receiver 62 as shown in FIG. 3. In embodiments, the system 200 may include the pressure transmitter 54, the AD converter 202, a decimation filter 204 (hereinafter "DF 204"), a band pass filter 206 (hereinafter "BPF 206"), low pass filters 208, 210 (hereinafter "LPFs 208, 210") and/or the receive 62.

The pressure transducer 54 may be connected to and/or in communication with the AD converter 202, and the pressure transducer 54 may transmit the incoming signal and/or the output 58 to the AD converter 202. The AD converter 202 may process and/or digitize the incoming signal and/or the output 58 received from the pressure transducers 54 to produce and/or generate a digital incoming signal. In embodiments, the filtering components of the AD converter 202 may include an anti-alias filter (not shown in the drawings) which may process and/or anti-alias filter the incoming signal and/or the digital incoming signal.

The AD converter 202 may be connected to and/or in communication with the DF 204, and the AD converter 202 may transmit the digital incoming signal to the DF 204. The DF 204 may perform and/or execute one or more mathematical operations on the digital incoming signal received from the AD converter 202 to reduce or increase one or more aspects of digital incoming signal and/or to decimate the digital incoming signal. As a result, the digital incoming signal may be processed and/or decimated by the DF 204. In embodiments, the DF 204 may include filtering components (not shown in the drawings), such as, for example, an analog-to-digital converter, a microprocessor, such as, for example, a digital signal processor and/or a digital-to-analog converter. The microprocessor may execute one or more software programs stored therein so that the DF 204 may perform and/or execute the one or more mathematical operations on the digital incoming signal received from the AD converter 202. In embodiments, a field-programmable gate array or a application-specific integrated circuit may be utilized instead of the microprocessor of the DF 204. It should be understood that the filtering components of the DF 204 may be any filter components as known to one of ordinary skill in the art.

The DF 204 may be connected to and/or in communication with the BPF 206, and the DF 204 may transmit the digital incoming signal to the BPF 206. The BPF 206 may be a device and/or a filter adapted to allow one or more frequencies within a frequency range of the BPF 206 to pass through the BPF 206 and/or to reject or attenuate one or more frequencies outside the frequency range of the BPF 206. In embodiments, the BPF 206 may be an analogue electronic band-pass filter, such as, for example, a resistor-inductor-capacitor circuit. The digital incoming signal may pass through the BPF 206 because the frequency associated with the digital incoming signal may be within the frequency range of the BPF 206. Moreover, the digital incoming signal may be processed and/or band pass filtered by the BPF 206. It should be understood that the BPF 206 may be any type of band-pass filter as known to one of ordinary skill in the art.

The BPF 206 may be connected to and/or in communication with the LPFs 208, 210, and the BPF 206 may transmit the digital incoming signal to the LPFs 208, 210. The digital incoming signal may be mixed into a first channel and a second channel before being received by the LPFs 208, 210. The first channel may be, for example, an I-channel, and the second channel may be, for example, a Q-channel. The BPF 206 may mix the digital incoming signal into the first and/or second channels before transmitting the digital incoming signal to the receiver 62. Alternatively, a device and/or a digital signal mixer (not shown in the drawings) may be located between the BPF 206 and the receiver 62 and may mix and/or split the digital incoming signal into the first and/or second channels.

The LPFs 208, 210 may be operational and/or functional at frequencies below a cutoff frequency for the LPFs 208, 210. The LPF 208 may receive the first channel, and the LPF 210 may receive the second channel. The LPFs 208, 210 may be a device and/or a filter adapted to allow one or more low-frequency signals below a cutoff frequency to pass through the LPFs 208, 210 and/or to reject and/or attenuate signals having frequencies higher than the cutoff frequency of the LPFs 208, 210. The digital incoming signal mixed into the first and second channels may pass through the LPFs 208, 210 because the frequency associated with the digital incoming signal mixed into the first and second channels may be below the cutoff frequency of the LPFs 208, 210. It should be understood that the cutoff frequency of the LPFs 208, 210 may be any frequency as known to one of ordinary skill in the art.

The LPFs 208, 210 may be connected to and/or in communication with the receiver 62, and the LPFs 208, 210 may transmit the digital incoming signal to the receiver 62. The LPF 208 may transmit the digital incoming signal mixed into the first channel to the receiver 62, and the LPF 210 may transmit the digital incoming signal mixed into the second channel to the receiver 62. Moreover, the digital incoming signal may be processed and/or low pass filtered by the LPFs 208, 210 and/or one or more OpenDSP data filters.

Thus, the bit pattern of the incoming signal and/or output 58 of the pressure transducer 54 may be transmitted from the pressure transducer 54 to the AD converter 202, the DF 204, BPF 206, the LPFs 208, 210 and/or the receiver 62 in accordance with the system 200. Moreover, the digital incoming signal may be transmitted from the AD converter 202 to the DF 204, BPF 206, the LPFs 208, 210 and/or the receiver 62 in accordance with the system 200.

In embodiments, the system 200 may have a differential filter, 212, a differential filter parameter estimator 214, a pressure recorder 216, a spectral estimator 218, a pump noise canceller 220, an oscilloscope display 222 and/or a signal strength estimation 224. The differential filter, 212, a differential filter parameter estimator 214, a pressure recorder 216, a spectral estimator 218, a pump noise canceller 220 may be connected to and/or in communication with the pressure transmitter 54, the ADC 202, the DF 204 and/or BPF 206. Moreover, the signal strength estimator 224 may be connected to and/or in communication with the LPFs 208, 210 and/or the receiver 62.

The digital incoming signal may be transmitted from the DF 204 and/or the BPF 206 to the differential filter 212, the differential filter parameter estimator 214, the pressure recorder 216, the spectral estimator 218, the pump noise canceller 220 and/or oscilloscope display 222. The differential filter 212, the differential filter parameter estimator 214, the pressure recorder 216, the spectral estimator 218, the pump noise canceller 220 and/or oscilloscope display 222 may process, filter and/or manipulate the digital incoming signal and/or may transmit a processed digital incoming signal to the BPF 206 and/or the LPFs 208, 210. The LPFs 208, 210 may transmit the digital incoming signal to the signal strength estimator 224. The signal strength estimator 224 may process the digital incoming signal and/or may transit the processed digital incoming signal to the receiver 62. In embodiments, the incoming signal, during transmission from the pressure transducer 54 to the receiver 62, may be anti-alias filtered, decimated, band pass filtered, mixed into I and Q channels and low pass filtered. The processed digital incoming signal may be received by the receiver 62 and/or may be processed, filtered and/or manipulated by the receiver 62. It should be understood that the processing, filtering and/or manipulating of the digital incoming signal by the differential filter 212, the differential filter parameter estimator 214, the pressure recorder 216, the spectral estimator 218, the pump noise canceller 220, oscilloscope display 222 and the signal strength estimator 224 may be any type processing, filtering and/or manipulating component as known to one of ordinary skill in the art.

The processed digital incoming signal may be transmitted from the LPFs 208, 210 and/or the signal strength estimator 224 to the receiver 62. The receiver 62 may process, filter and/or manipulate the processed digital incoming signal received from the LPFs 208, 210 and/or the signal strength estimator 224. As a result, the receiver 62 may extract one or more sequences of one or more symbols from the processed digital incoming signal. The extracted sequence of symbols which may be extracted by the receiver 62 may contain the actual and/or original bit pattern from the actual and/or original incoming signal which may have been transmitted to the pressure transducers 54, 56 via the drilling fluid channel and the telemetry pressure wave. The extracted sequence of symbols may contain and/or include actual and/or original bit pattern and/or symbols associated with acquired data that was gathered downhole by the transducer 42. Moreover, the extracted sequence of symbols may entirely or partially contain the actual and/or original bit pattern and/or symbols associated with the acquired data.

The receiver 62 may include, combined and/or incorporate at least two types of receivers (not shown in the drawings), such as, for example, an equalizer receiver and a probability receiver operating and/or functioning according to a probability theory, such as, for example, a Bayesian receiver. In embodiments, the receiver 62 may function and/or operate as a probability receiver and an equalizer receiver. Thus, the receiver 62 may include components (not shown in the drawings), such as, for example, software and/or hardware associated with a probability receiver and an equalizer receiver. Further, the receiver 62 may be programmed such that the receiver 62 may conduct operations, functionalities and/or processes associated with a probability receiver and an equalizer receiver. As a result, the receiver 62 may process, analyze and manipulate the extracted sequence of symbols in a manner which may be the same as or substantially the same as a probability receiver and an equalizer receiver. Still further, the receiver 62 may operate and/or function according to (1) an implementation of the probability theory via the probability receiver and (2) a linear filter or a complex algorithm via the equalizer receiver. Moreover, the receiver 62 may perform and/or execute the two or more data comparisons (hereinafter "the data comparisons") via the probability and equalizer functionalities and/or processes.

The receiver 62 may utilize the implementation of the probability theorem which sets forth that a probability of an unknown may be derived from the probabilities of all possibilities. In other words, the extracted sequence of symbols may be compared with one or more possible matching and/or corresponding digital signals of the set of idealized model data via the receiver 62 in accordance with the first data comparison. The receiver 62 may perform and/or execute the first data comparison for the extracted sequence of symbols. The receiver 62 may compare the extracted sequence of symbols to the one or more possible matching and/or corresponding digital signals of the set of idealized model data via the first data comparison. The one or more possible matching and/or corresponding digital signals may contain and/or be defined by the idealized bit patterns.

From first data comparison, the receive 62 may identify a first data comparison result (hereinafter "the first result") which may be a first matching and/or corresponding digital signal from the set of idealized model data. The first result and/or first matching and/or corresponding digital signal may have an idealized bit pattern which may match and/or may be the same as or substantial the same as a bit pattern associated with the extracted sequence of symbols. Variances associated with the first data comparison may be normalized and/or may result in a calibrated probability on a scale from, for example, 0 to 1.

The implementation of the probability theory, such as, for example, the Bayesian probability theory utilized by the receiver 62 may simplify mathematical operations and/or calculations associated with the Bayesian probability theory and/or the first data comparison. As a result, a performance of the receiver 62 and/or the CPU 64 may be surprisingly and unexpectedly improved when the extracted sequence of symbols may have a large block size. For example, the implementation of the Bayesian probability theory may not require or necessitate the receiver 62 to fully or partially examine and/or analyze all of the one or more possible matching and/or corresponding digital signals of the set of idealized model data in detail. According to the implementation of the probability theory, most likely idealized versions of the extracted sequence of symbols may be examined and/or analyzed completely and/or in detail by the receiver 62. The most likely idealized versions of the extracted sequence of symbols may be determined by a coarse, broad and/or short examination of the extracted sequence of symbols or the prior extracted sequence of symbols by the receiver 62 prior to execution of the first data comparison.

The receiver 62 may analyze and/or process the extracted sequence of symbols to identify and/or determine a known pattern with the functionality and/or processes associated with the equalizer receiver according to the second data comparison. After identifying and/or determining the known pattern, the receiver 62 may identify and/or determine one or more sets of one or more mathematical operations (hereinafter "the set of mathematical operations") which may be applied to the extracted sequence of symbols. The receiver 62 may apply the set of mathematical operations to the extracted sequence of symbols which may re-shape the extracted sequence of symbols into a theoretical perfect sequence of symbols and/or a theoretical perfect signal. The theoretical perfect sequence of symbols and/or a theoretical perfect signal may be collectively referred to as the equalized version of the incoming signal. The receiver 62 may have one or more microprocessors (not shown in the drawings), memory (not shown in the drawings) and/or one or more storage medium (not shown in the drawings). The receiver 62 may store the set of mathematical operations applied to the extracted sequence of symbols in a memory or storage medium associated with the receiver 62 and/or the CPU 64, and the receiver 62 may access, retrieve and/or apply the set of mathematical operations to subsequently received digital incoming signals and/or extracted sequences of symbols.

The receiver 62 may perform and/or execute the second data comparison for the extracted sequence of symbols. The receiver 62 may compare the equalized version of the incoming signal to the one or more possible matching and/or corresponding digital signals of the set of idealized model data via the second data comparison. For the second data comparison, the receiver 62 may identify a second data comparison result (hereinafter "the second result") which may or may not be the first matching and/or corresponding digital signal from the set of idealized model data. The second result and/or the first matching and/or corresponding digital signal may having the idealized bit pattern which may match and/or may be the same as or substantial the same as a bit pattern associated with the equalized version of the incoming signal.

Alternatively, the second result may be a second matching and/or corresponding digital signal from the set of idealized model data based on the results of the second data comparison. The second matching and/or corresponding digital signal may having an idealized bit pattern which may match and/or may be the same as or substantial the same as a bit pattern associated with the equalized version of the incoming signal.

In embodiments, the receiver 62 may determine an estimation for a channel response based on the extracted sequence of symbols and/or may utilize the estimation for the channel response to generate the modified set of idealized model data. The modified set of idealized model data may be an additional set of idealized model data which may be a modification of the original idealized model data created by the receiver 62 based on the estimation for the channel response. The modified set of idealized model data created by the receiver 62 may account for and/or correspond to one or more effects and/or characteristics of the drilling fluid channel whereby the incoming signal is transmitted uphole from the transducer 42 to the receiver 62.

The receiver 62 may perform and/or execute the third data comparison for the extracted sequence of symbols. The receiver 62 may compare the extracted sequence of symbols to one or more possible matching and/or corresponding digital signals of the modified set of idealized model data via the third data comparison. The one or more possible matching and/or corresponding digital signals of the modified set of idealized model data may contain and/or be defined by one or more modified idealized bit patterns. The one or more modified set of idealized bit patterns may be created by the receiver 62 based on the estimation for the channel response. For the third data comparison, the receiver 62 may identify a third data comparison result (hereinafter "the third result") which may be a third matching and/or corresponding digital signal from the modified set of idealized model data. The third result and/or the third matching and/or corresponding digital signal may have a modified idealized bit pattern which may match and/or may be the same as or substantial the same as a bit pattern associated with the extracted sequence of symbols.

In embodiments, the receiver 62 may update, change and/or modify the initial set of idealized model data based on the modified set of idealized data and/or the estimation for a channel response. The receiver 62 may replace the initial set of idealized model data with the modified set of idealized data. As a result, the initial set of idealized model data may reflect and/or consider the estimation for a channel response. It should be understood that the set of idealized model data may be updated, change and/or modify as often and/or periodically as known to one of ordinary skill in the art.

Periodically or non-periodically, the receiver 62 may re-evaluate one or more required operations associated with the receiver 62, the drilling fluid channel and/or the system 200. The one or more required operations may be re-evaluated by the receiver 62 based upon the extracted sequence of symbols being identified as the 'known' pattern or based on an actual known pattern, such as, for example, a frame sync word and/or the like. The receiver 62 may update the idealized model data based on the one or more required operations.

The receiver 62 achieves surprising and unexpected advantages by (1) utilizing the implementation of the Bayesian probability theory for comparing the extracted sequence of symbols with the set of idealized model data, (2) comparing the equalized version of the extracted sequence of symbols with the set of idealized model data, and (3) comparing the extracted sequence of symbols with the modified set of idealized model data. Moreover, the receiver 62 may surprisingly and unexpectedly exhibit an improved performance, while maintaining good bit confidence measurements, and/or may reduce or eliminate inherent double error for every single error event. Additionally, the equalizer functionality of the receiver 62 may surprisingly and unexpectedly cancel at least a portion of noise and/or distortion associated with the incoming signal and/or the digital incoming signal while retaining advantages of the increased bit confidence measurement and/or reduced the double bit error due.

In embodiments, the first matching and/or corresponding digital signals may be the same or the substantially same digital signal and/or bit pattern as the second and/or third matching and/or corresponding digital signals. In embodiments, the second matching and/or corresponding digital signals may be the same or substantially same digital signal and/or bit pattern as the first and/or third matching and/or corresponding digital signals. In embodiments, one or more of the first, second and third matching and/or corresponding digital signals may be entirely or partially different digital signals.

The receiver 62 may determine, select and/or identify an ideal results from the first, second and/or third results. The receiver 62 may determine, select and/or identify an ideal matching and/or corresponding digital signal from the first, second and third matching and/or corresponding digital signals. The receiver 62 may determine, select and/or identify the ideal matching and/or corresponding digital signals based on which one of the first, second and third results or the first, second and third matching and/or corresponding digital signals may most accurately or most substantially accurately match and/or correspond to the extracted sequence of symbols. As a result, the ideal result or ideal matching and/or corresponding digital signal may match and/or correspond to or may substantially match and/or correspond to the extracted sequence of symbols, and the ideal matching and/or corresponding digital signal. The ideal result or the ideal matching and/or corresponding digital signal may contain and/or be defined by an idealized bit pattern which may be the same as or substantially the same as the bit pattern of the digital incoming signal and/or the extracted sequence of symbols. As a result, the ideal result or the ideal matching and/or corresponding digital signal identified and/or selected by the receiver 62 may match or substantially match the incoming signal originally received by the pressure transducers 54, 56 and/or transmitted uphole by the transducer 42.

The receiver 62 may identify the ideal result or the ideal matching and/or corresponding digital signal as the decoded signal for the incoming signal originally received by the pressure transducers 54, 56, the digital incoming signal received by the receiver 62 and/or the extracted sequence of symbols. The identified decoded signal may accurately match, substantially match, represent or correspond to the incoming signal originally received by the pressure transducers 54, 56, the digital incoming signal received by the receiver 62 and/or the extracted sequence of symbols. As a result, the actual and/or originally acquired data, the original incoming signal, the bit pattern associated with the original incoming signal may be identified as and/or represented by the decoded signal, a bit pattern associated with the decoded signal and/or information or symbols contained within, represented by and/or associated with the decoded signal.

In embodiments, the receiver 62 may initialize demodulation of the I and Q channels via the OpenDSP data filter with at least one of an anti-alias filter, a bandpass filter, and/or a symbol rate filter. The demodulation of the I and Q channels may be executed and/or obtained by utilizing inverse fast Fourier transform (IFFT) of a desired frequency response. The receiver 62 may utilize the symbol rate filter for creation of the set of idealized model data. The receiver 62 may or may not utilize the BPF 206 to create of the set of idealized model data. However, a non-symmetrical band-pass filter (not shown in the drawings) may be utilized, such as, for example, a strong mud pump harmonic on an end or a null on a side of the band, and the BPF 206 may be utilized to surprisingly and unexpectedly improve performance of the receiver 62. Alternatively, band-pass filtered models may be desirable and/or may be utilized as, for example, a user option associated with the receiver 62.

The receiver 62 may perform at least two or three or more data comparisons with the set of idealized model data, the modified set of idealized model data, the extracted sequence of symbols and/or the equalized version of the extract sequence of symbols. The receiver 62 may select and/or identify the idealized result from one of the first, second or third result which may have a highest bit confidence based on the processes and/or data comparisons. Additionally, the receiver 62 may select and identified an idealized result from one of the first, second or third matching and/or corresponding digital signals which may have a highest bit confidence based on the processes and/or data comparisons. The selected and/or identified matching and/or corresponding digital signals and/or the idealized result may be referred to as the data comparison output.

By performing the at least two or the three or more data comparisons, the receiver 62 may exhibit or achieve an advantageous bit analysis of the incoming signal and/or the extracted sequences of symbols. For example, the receiver 62 may have an improved analysis of symbols in a middle of the extracted sequence when compared to an analysis of the symbols near one or more edges of the extracted sequence because the symbols near the one or more edges may not be compensated by one or more adjacent symbols within the extracted sequences of symbols. The receiver 62 may process and/or analysis each and/or every symbol at a number of different positions relative to the one or more edges of the extracted sequence of symbols. As a result, the receiver 62 may determine and/or identifying a final output for the extracted sequence of symbols based on the analysis of each and/or every symbol within the extracted sequences of symbols.

Moreover, the receiver 62 may process extracted sequences of symbols having large batch sizes and/or small batch sizes to determine and/or identify the final output. Processing an extracted sequence of symbols having a large batch size via the receiver 62 may be computationally resource intensive. However, performance by the receiver 62 may increase and/or be improved when processing an extracted sequence of symbols having a small batch. In embodiments, the receiver 62 may perform and/or execute a final comparison and/or analysis of an extracted sequence of symbols having a large bit size based on a comparison of an extracted sequence of symbols having a small batch size. During the analysis of the extracted sequence of symbols having the large batch size, the receiver 62 may compare a limited number of possibilities for the extracted sequence having the large bit size because a majority or substantial majority of the possibilities for the extracted sequence having the large bit size may have been previously rejected at an earlier stage of the analysis based on one or more comparisons of one or more extracted sequences having the small batch size.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method for identifying a decoded signal for an incoming signal, the method comprising:

processing an incoming signal via a signal processing receiver, wherein the receiver extracts at least one sequence of one or more symbols from the incoming signal to generate an extracted sequence of symbols;

performing a first data comparison with the extracted sequence of symbols and one or more possible matching signals of a set of idealized model data according to a probability theory, wherein the first comparison generates a first result;

performing a second data comparison with an equalized version of the incoming signal and the one or more possible matching signals of the set of idealized model data, wherein the second comparison generates a second result;

performing a third data comparison with the extracted sequence of symbols and one or more possible matching signals of a modified set of idealized model data, wherein the third data comparison generates a third result; and identifying a decoded signal for the incoming signal based on the first, second and third results.

2. The method according to claim 1, wherein the incoming signal is a digital incoming signal.

3. The method according to claim 1, further comprising:

identifying a known pattern of the extracted sequence of symbols; and applying one or more sets of one or more mathematical operations to the extracted sequence of symbols to generate the equalized version of the incoming signal.

4. The method according to claim 3, wherein the probability theory is a Bayesian probability theory.

5. The method according to claim 1, further comprising:

determining an estimation for a channel response based on the extracted sequence of symbols; and generating the modified set of idealized model data based on the estimation for the channel response.

6. The method according to claim 5, further comprising:

replacing the set of idealized model data with the modified set of idealized model data.

7. The method according to claim 1, further comprising:

comparing the first, second and third result to determine an idealized result from the first, second and third results, wherein the idealized result has a bit pattern that is substantially the same as the extracted sequence of symbols, wherein the decoded signal for the incoming signal is based on idealized result.

8. A system for identifying a decoded signal for an incoming signal, comprising:

a signal processing receiver adapted to receive an incoming signal, wherein the receiver extracts at least one sequence of one or more symbols from the incoming signal to generate an extracted sequence of symbols;

first means for comparing the extracted sequence of symbols and one or more possible matching signals of a set of idealized model data according to a probability theory, wherein the first means for comparing generates a first result;

second means for comparing an equalized version of the incoming signal and the one or more possible matching signals of the set of idealized model data, wherein the second means for comparing generates a second result;

means for identifying a decoded signal for the incoming signal based on an idealized result determined from at least the first and second results, wherein the idealized result has a bit pattern that is substantially the same as the extracted sequence of symbols.

9. The system according to claim 8, further comprising:

third means for comparing the extracted sequence of symbols of the incoming signal and one or more possible matching signals of a modified set of idealized model data, wherein the third means for comparing generates a third result, wherein the idealized result is determined from the first, second and third results.

10. The system according to claim 9, wherein the receiver compares a limited number of possibilities for an extracted sequence having a large bit size and rejects a substantial majority of possibilities for the extracted sequence having the large bit size based on at lease one of the first, second and third results.

11. The system according to claim 8, wherein the receiver is configured to analyze one or more symbols in a middle of the extracted sequence of symbols without allowing one or more adjacent symbols within the extracted sequence of symbols to compensate one or more symbols near one or more edges of the extracted sequence of symbols, wherein the one or more adjacent symbols are adjacent to the one or more symbols near the one or more edges of the extracted sequence of symbols.

12. The system according to claim 8, wherein the probability theory is a Bayesian probability theory.

13. The system according to claim 8, wherein the incoming signal is a digital incoming signal.

14. Computer-readable storage medium having stored thereon one or more programs that enable a processor to process data and information, wherein the one or more programs comprises a series of program instructions which when executed by a processor using software cause the processor to:

extract at least one sequence of symbols from an incoming signal to generate an extracted sequence of symbols;

generate a first result based on a comparison of the extracted sequence of symbols and one or more possible matching signals of a set of idealized model data according to a probability theory;

generate a second result based on a comparison of the extracted sequence of symbols and one or more possible matching signals of a modified set of idealized model data; and identify a decoded signal for the incoming signal based on an idealized result determined from at least the first and second results, wherein the idealized result has a bit pattern that is substantially the same as the extracted sequence of symbols.

15. The computer-readable storage medium according to claim 14, wherein the series of program instructions which when executed by a processor using software further cause the processor to:

generate a third result based on a comparison of an equalized version of the incoming signal and the one or more possible matching signals of the set of idealized model data, wherein the idealized result is determined from the first, second and third results.

16. The computer-readable storage medium according to claim 14, wherein the series of program instructions which when executed by a processor using software further cause the processor to:

apply one or more sets of one or more mathematical operations to the extracted sequence of symbols to generate the equalized version of the incoming signal, wherein the one or more sets of one or more mathematical operations are based on a known pattern of the extracted sequence of symbols.

17. The computer-readable storage medium according to claim 14, wherein the series of program instructions which when executed by a processor using software further cause the processor to:

generate the modified set of idealized model data by utilizing an estimation for a channel response to generate the modified set of idealized model data, wherein the estimation for the channel response is based on the extracted sequence of symbols.

18. The computer-readable storage medium according to claim 17, wherein the series of program instructions which when executed by a processor using software further cause the processor to:

replace the set of idealized model data with the modified set of idealized model data.

19. The computer-readable storage medium according to claim 14, wherein the incoming signal is a digital incoming signal.

20. The computer-readable storage medium according to claim 14, wherein the probability theory is a Bayesian probability theory.

* * * * *